US008272723B2

(12) United States Patent
Takeuchi et al.

(10) Patent No.: US 8,272,723 B2
(45) Date of Patent: Sep. 25, 2012

(54) INK CARTRIDGE AND IMAGE FORMING APPARATUS EMPLOYING THE INK CARTRIDGE

(75) Inventors: Shotaro Takeuchi, Atsugi (JP); Hiroyuki Yamashita, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 360 days.

(21) Appl. No.: 12/652,871

(22) Filed: Jan. 6, 2010

(65) Prior Publication Data

US 2010/0171799 A1 Jul. 8, 2010

(30) Foreign Application Priority Data

Jan. 6, 2009 (JP) ..... 2009-000630

(51) Int. Cl.
*B41J 2/175* (2006.01)

(52) U.S. Cl. ..... 347/86; 347/85

(58) Field of Classification Search ..... 347/85, 347/86, 87
See application file for complete search history.

(56) References Cited

U.S. PATENT DOCUMENTS

| | | | | |
|---|---|---|---|---|
| 6,116,723 | A | 9/2000 | Childers | |
| 6,158,853 | A * | 12/2000 | Olsen et al. | 347/86 |
| 6,243,115 | B1 * | 6/2001 | Baker et al. | 347/85 |
| 6,715,864 | B2 * | 4/2004 | Perkins et al. | 347/86 |
| 6,874,878 | B2 * | 4/2005 | Sugata | 347/86 |
| 7,527,367 | B2 * | 5/2009 | Morita | 347/86 |
| 2004/0201654 | A1 | 10/2004 | Morita | |
| 2009/0256892 | A1 | 10/2009 | Takeuchi | |

FOREIGN PATENT DOCUMENTS

| | | | |
|---|---|---|---|
| EP | 0941854 | A2 | 9/1999 |
| EP | 1466738 | A1 | 10/2004 |
| JP | 11-300984 | A | 11/1999 |
| JP | 2003-220710 | | 8/2003 |
| JP | 2004-306505 | | 11/2004 |
| JP | 2007-144744 | | 6/2007 |

OTHER PUBLICATIONS

Apr. 12, 2010 European search report in connection with counterpart European patent application No. 10 25 0003.

* cited by examiner

*Primary Examiner* — Anh T. N. Vo

(74) *Attorney, Agent, or Firm* — Cooper & Dunham LLP

(57) ABSTRACT

An ink cartridge includes an inner pack that stores ink, an outer pack that packs the inner pack and into which gas is introduced to squeeze the inner pack to supply the ink to an exterior of the ink cartridge, and a cartridge case having a housing portion to enclose the outer pack and an inner wall surface against which the outer pack is inflated to be pressed as gas is introduced into the outer pack.

8 Claims, 9 Drawing Sheets

INK CARTRIDGE AND IMAGE FORMING APPARATUS EMPLOYING THE INK CARTRIDGE

BACKGROUND OF THE INVENTION

1. Field of the Invention

Illustrative embodiments of the present invention relate to an ink cartridge and an image forming apparatus, and more specifically, to an image forming apparatus having a recording head that ejects droplets and an ink cartridge detachably mounted in the image forming apparatus.

2. Description of the Background

Image forming apparatuses are used as printers, facsimile machines, copiers, plotters, or multi-functional peripherals having two or more of the foregoing capabilities. As one type of image forming apparatus employing a liquid-ejection recording method, an inkjet recording apparatus is known that ejects liquid droplets from a recording head onto a recording medium to form a desired image.

Such an inkjet-type image forming apparatus falls into two main types: a serial-type image forming apparatus that forms an image by ejecting droplets while moving a recording head in a main scan direction, and a line-head-type image forming apparatus that forms an image by ejecting droplets from a linear-shaped recording head fixedly disposed in the image forming apparatus.

Such an inkjet-recording-type image forming apparatus (hereinafter, an "inkjet recording apparatus") may have a sub tank (buffer tank or head tank) mounted on a carriage on which the recording head is mounted and a main ink cartridge (main tank) detachably mounted in the image forming apparatus. In such a case, ink is supplied (filled) from the ink cartridge to the sub tank.

For example, conventional ink cartridges like those described in Japanese Patent Application Laid-Open Nos. 2004-306505 and 2003-220710 have a cartridge case that houses a double pack including an inner pack and an outer pack. The inner pack serves as an ink pack to store ink. The outer pack packs the inner pack and has a space outside the inner pack into which compressed air is introduced. By the compressed air introduced into the outer pack, the inner pack is pressed to supply ink to the recording head.

However, in the above-described conventional ink cartridges having the double pack structure, since the size of the outer pack into which air is introduced is smaller than the capacity of the cartridge case, the outer pack endures by itself air pressure applied to supply a good amount of ink. Such a configuration may require an enhanced strength of the outer pack. Further, if the outer pack is formed by welding, the strength of welding need be enhanced.

In particular, the capacity of ink cartridge has recently been increased to meet a demand for raising the image formation speed while stably supplying ink. However, since an increased pressure in the outer pack might burst the outer pack, the above-described conventional ink cartridge may not achieve ink supply compatible with stable high-speed printing. Further, since the internal pressure of the outer pack is proportional to the area of the outer pack, the outer pack might break from a welded portion due to internal pressure when the outer pack is formed by welding in a large capacity of ink cartridge. Accordingly, such a large capacity may not be easily achieved in the above-described conventional ink cartridge. Alternatively, it is conceivable that by increasing the thickness of the outer pack, the strength of the outer pack may be enhanced so as to endure a high pressure. However, such a configuration may prevent cost reduction.

SUMMARY OF THE INVENTION

In one illustrative embodiment, an ink cartridge includes an inner pack that stores ink, an outer pack that packs the inner pack and into which gas is introduced to squeeze the inner pack to supply the ink to an exterior of the ink cartridge, and a cartridge case having a housing portion to enclose the outer pack and an inner wall surface against which the outer pack is inflated to be pressed as gas is introduced into the outer pack.

In another illustrative embodiment, an image forming apparatus includes an ink cartridge detachably mountable in the image forming apparatus. The ink cartridge includes an inner pack that stores ink, an outer pack that packs the inner pack and into which gas is introduced to squeeze the inner pack to supply the ink to an exterior of the ink cartridge, and a cartridge case having a housing portion to enclose the outer pack and an inner wall surface against which the outer pack is inflated to be pressed as gas is introduced into the outer pack.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
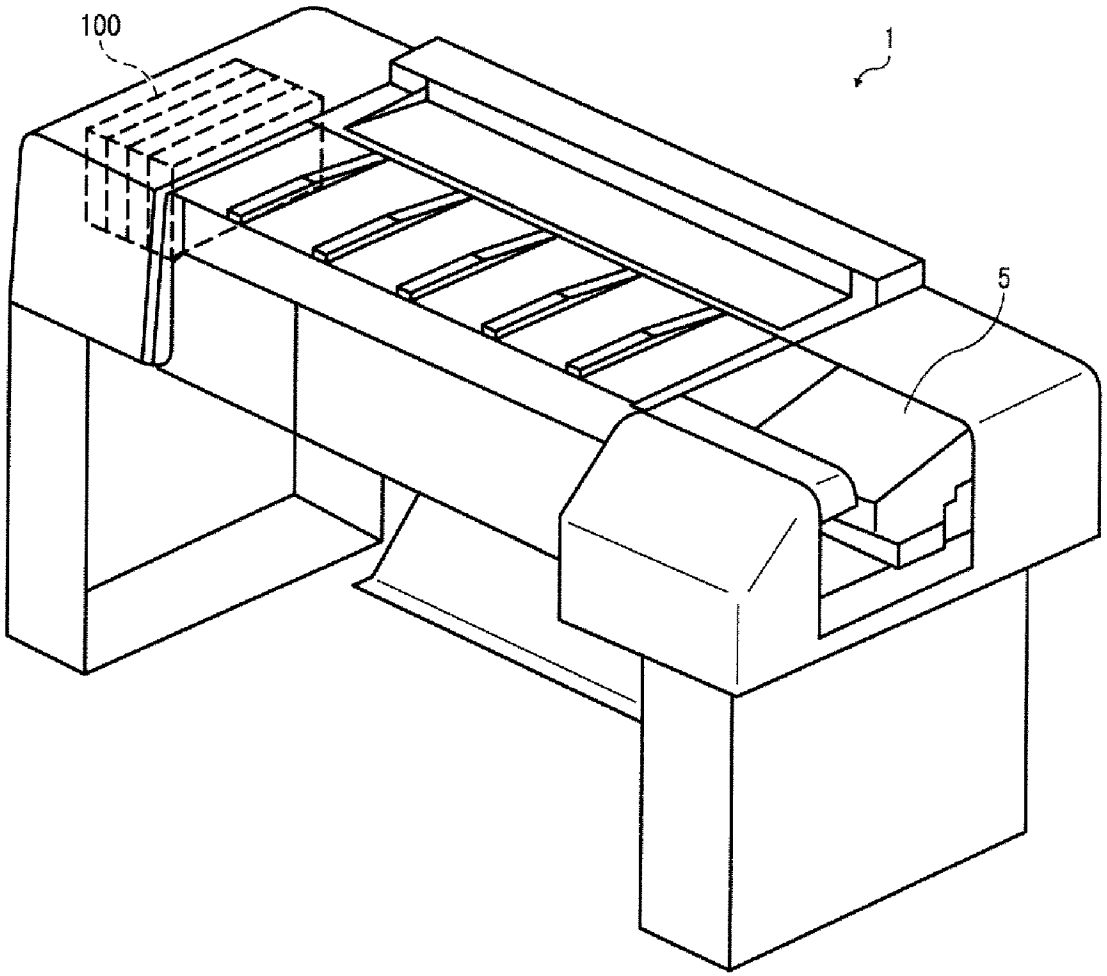
FIG. 1 is a perspective view illustrating an example of an inkjet recording apparatus according to an illustrative embodiment of the present disclosure.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, the term "sheet" used herein refers to a medium, a recording medium, a recorded medium, a sheet material, a transfer material, a recording sheet, a sheet of paper, or the like. The sheet may also be made of material such as paper, string, fiber, cloth, leather, metal, plastic, glass, timber, and ceramic. The term "image forming apparatus" used herein refers to an apparatus that ejects liquid droplets on the sheet. Further, the term "image formation" used herein refers to forming, recording, printing images to the sheet, and includes providing meaningful images such as characters and figures as well as meaningless images such as patterns to the sheet. The term "image formation" may also simply refer to landing liquid droplets onto the sheet. Moreover, the term "ink" used herein is not limited to ink in a narrow sense and includes anything ejected in fluid form, such as a DNA sample, resist, pattern material, washing fluid, storing solution, and fixing solution.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

Below, illustrative embodiments according to the present invention are described with reference to attached drawings.

Figure 2:
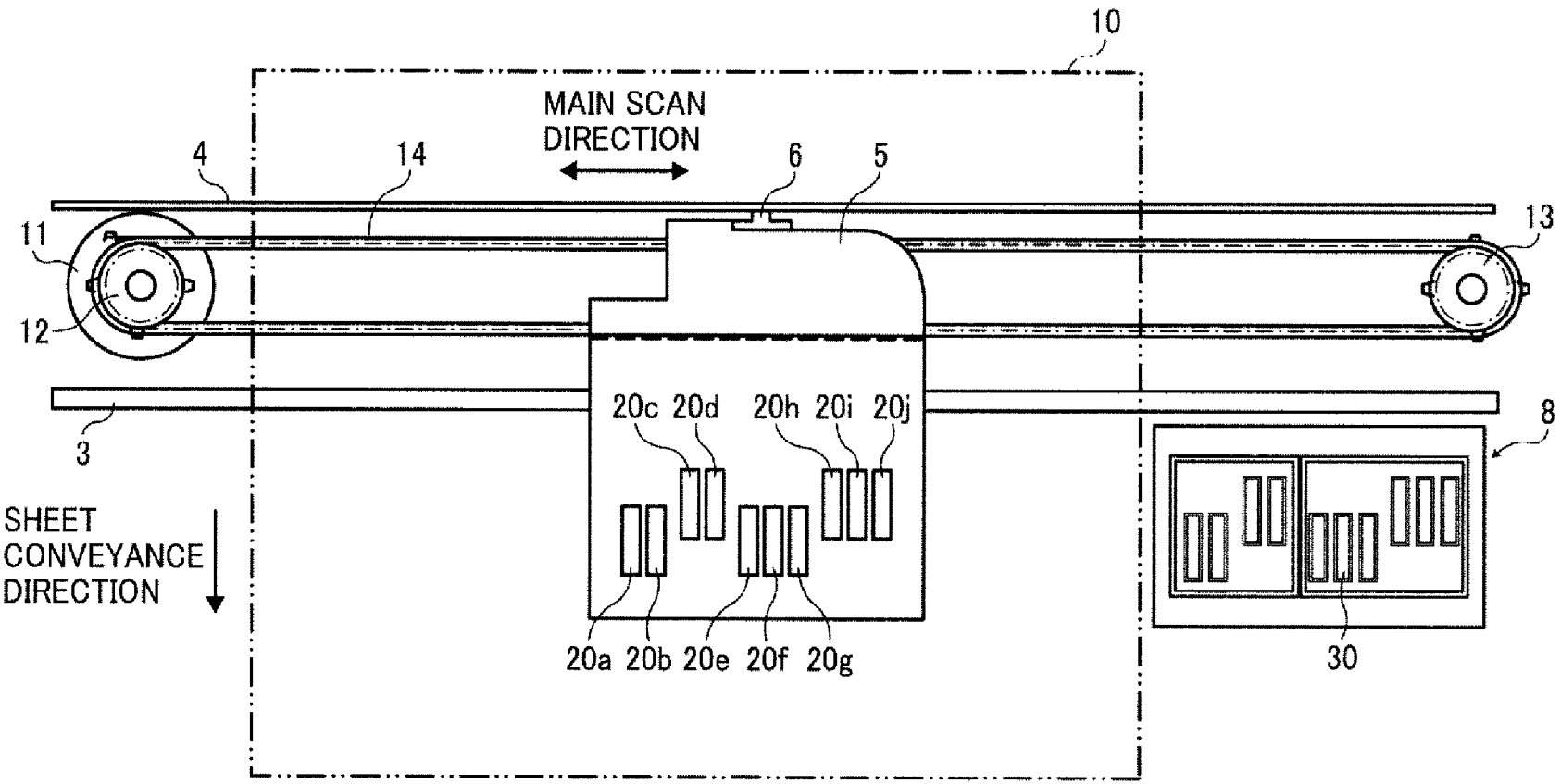
FIG. 2 is a plan view illustrating a printing section of the inkjet recording apparatus illustrated in FIG. 1.
Figure 3:
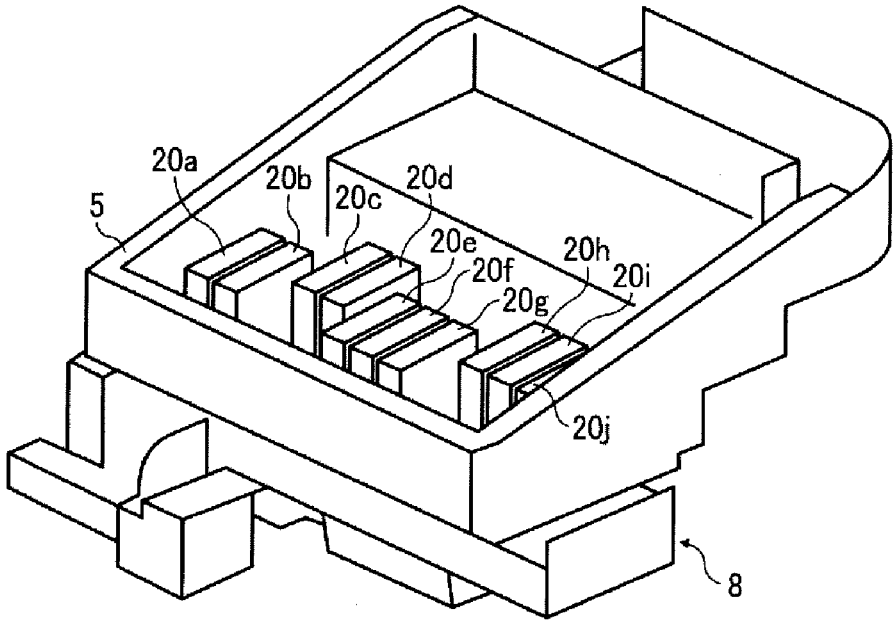
FIG. 3 is a perspective view illustrating a carriage and a maintenance-and-recovery unit.

First, a description is given of an inkjet recording apparatus 1 as one example of an image forming apparatus according to an illustrative embodiment of the present disclosure with reference to FIGS. 1 to 3. FIG. 1 is a perspective view illustrating a configuration of the inkjet recording apparatus 1. FIG. 2 is a plan view illustrating a printing section of the inkjet recording apparatus 1. FIG. 3 is a perspective view illustrating a carriage 5 and a maintenance-and-recovery unit 8.

The inkjet recording apparatus 1 is illustrated as a serial-type inkjet recording apparatus. In the inkjet recording apparatus 1, a guide rod 3 and a guide rail 4 are extended between side plates. A carriage 5 is supported with both the guide rod 3 and the guide rail 4 so as to slide in a main scan direction. The guide rail 4 contacts a sub guide roller 6 that is rotationally supported at a rear portion of the carriage 5.

A main scan unit to move the carriage 3 for scanning includes a driving motor 11 located at one end of the main scan direction, a driving pulley 12 rotated by the driving motor 11, a driven pulley 13 located at the other end of the main scan direction, and a timing belt (belt member) 14 extended between the driving pulley 12 and the driven pulley 13. A tension spring gives tension to the driven pulley 13 in an outward direction, i.e., a direction away from the driving pulley 12.

The driving pulley 12 and the driven pulley 13 are disposed in such a manner that an axial direction of each pulley is parallel to a direction in which ink droplets are ejected (hereinafter, referred to as "ink-droplet ejecting direction"). A portion of the belt member 14 extended between the driving pulley 12 and the driven pulley 13 is fixed on a belt fixing portion at the rear side of the carriage 5. Thus, the belt member 14 is located at one side of the carriage 5 in a direction (hereinafter, a "sub-scan direction") perpendicular to the main scan direction.

In FIG. 2, the carriage 5 has a head base, not illustrated, on which recording heads 20*a* to 20*j* (hereinafter, referred to as "recording heads 20" unless colors are distinguished) with ten pieces of buffer tanks (sub tanks) are mounted. The recording heads 20 are formed with liquid ejection heads having nozzles from which ink droplets of different colors, e.g., black (K), yellow (Y), magenta (M), and cyan (C) are ejected. In such a configuration, a first set of the recording heads 20*a* and 20*b* and a second set of the recording heads 20*c* and 20*d* may be staggered in a direction in which a sheet is conveyed (hereinafter, "sheet conveyance direction") and used as recording heads that eject, for example, black ink droplets. Further, a third set of the recording heads 20*e* to 20*g* and a fourth set of the recording heads 20*h* to 20*j* may be staggered in the sheet conveyance direction. In such a case, the recording heads 20*e* and 20*h* eject cyan ink droplets, the recording heads 20*f* and 20*i* eject magenta ink droplets, and the recording heads 20*g* and 20*j* eject yellow ink droplets. With such a configuration, an area covered with two heads in the sheet conveyance direction can be printed by a single main-scan operation.

In the main scan area of the carriage 5, the sheet 10 is intermittently conveyed at a recording area using a sheet feed unit, not illustrated, while being guided with a platen member in the sub-scan direction perpendicular to the main scan direction of the carriage 5. The platen member is disposed facing the recording heads 20 in at least the recording area along the main scan area of the carriage 5.

The maintenance-and-recovery unit 8 is disposed at one end of the main scan area to maintain and recovery conditions of the recording heads 20. The maintenance-and-recovery unit 8 includes caps 30 that seal (cap) the surfaces of nozzles of the recording heads 20*a* to 20*j* and a wiper member that wipes the nozzle surfaces.

As illustrated in FIG. 1, ink cartridges (main tanks) 100 that store respective color inks supplied to the recording heads 20 are detachably mounted outside the other end of the main scan area.

The inkjet recording apparatus 1 ejects droplets by driving the recording heads 20 in accordance with image information, while moving the carriage 5 in the main scan direction and intermittently conveying the sheet 10 in the sub-scan direction. Thus, a desired image is formed on the sheet 10.

Figure 4:
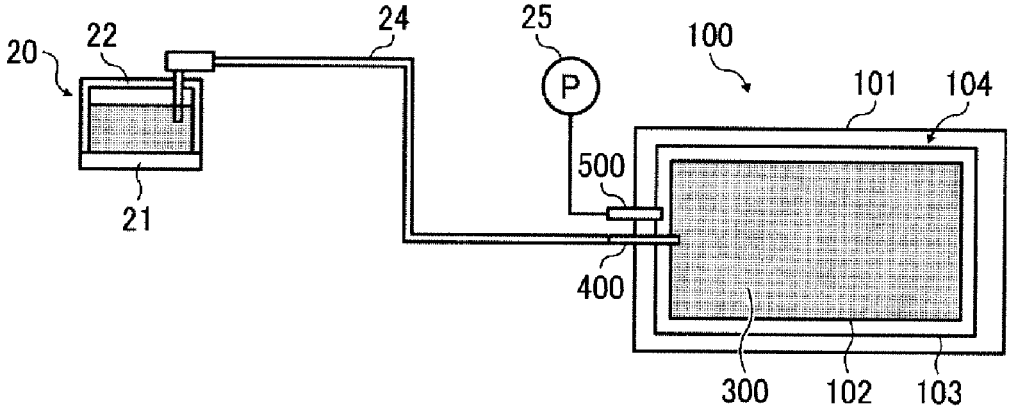
FIG. 4 is a schematic view illustrating an ink supply system of the inkjet recording apparatus illustrated in FIG. 1.

Next, an ink supply system of the inkjet recording apparatus 1 is described with reference to FIG. 4.

The ink supply system includes the recording heads 20 and the ink cartridges 100. Each of the recording heads 20 includes a head section 21 formed with the liquid ejection heads that eject droplets and a buffer tank (sub tank) 22 that supplies ink to the head section 21. The ink cartridges 100 serve as main tanks that store ink supplied to the recording heads 20. In the ink supply system, ink is supplied or filled from the ink cartridges 100 to the buffer tanks 22 through supply tubes 24 in response to ink consumption.

Each of the ink cartridges 100 includes a double pack 104 and a cartridge case 101 that houses the double pack 104. The double pack 104 includes an ink pack 102 serving as an inner pack that stores ink 300 and an air pack 103 serving as an outer pack that packs the ink pack 102. When gas (in this example, air) is introduced into the air pack 103, the ink pack 102 is squeezed by the air to supply the ink 300 to the outside of the ink cartridge 100. In this configuration, by introducing air into the air pack 103 using a pump 25, the ink pack 102 is squeezed by the air to supply the ink 300 to the recording heads 20. The supply tube 24 and the ink pack 102 are connected with a hollow needle 400, and the pump 25 is detachably connected to the air pack 103 via an air joint 500.

Next, the ink cartridge 100 is described in further details with reference to FIGS. 5 to 10.

Figure 5:
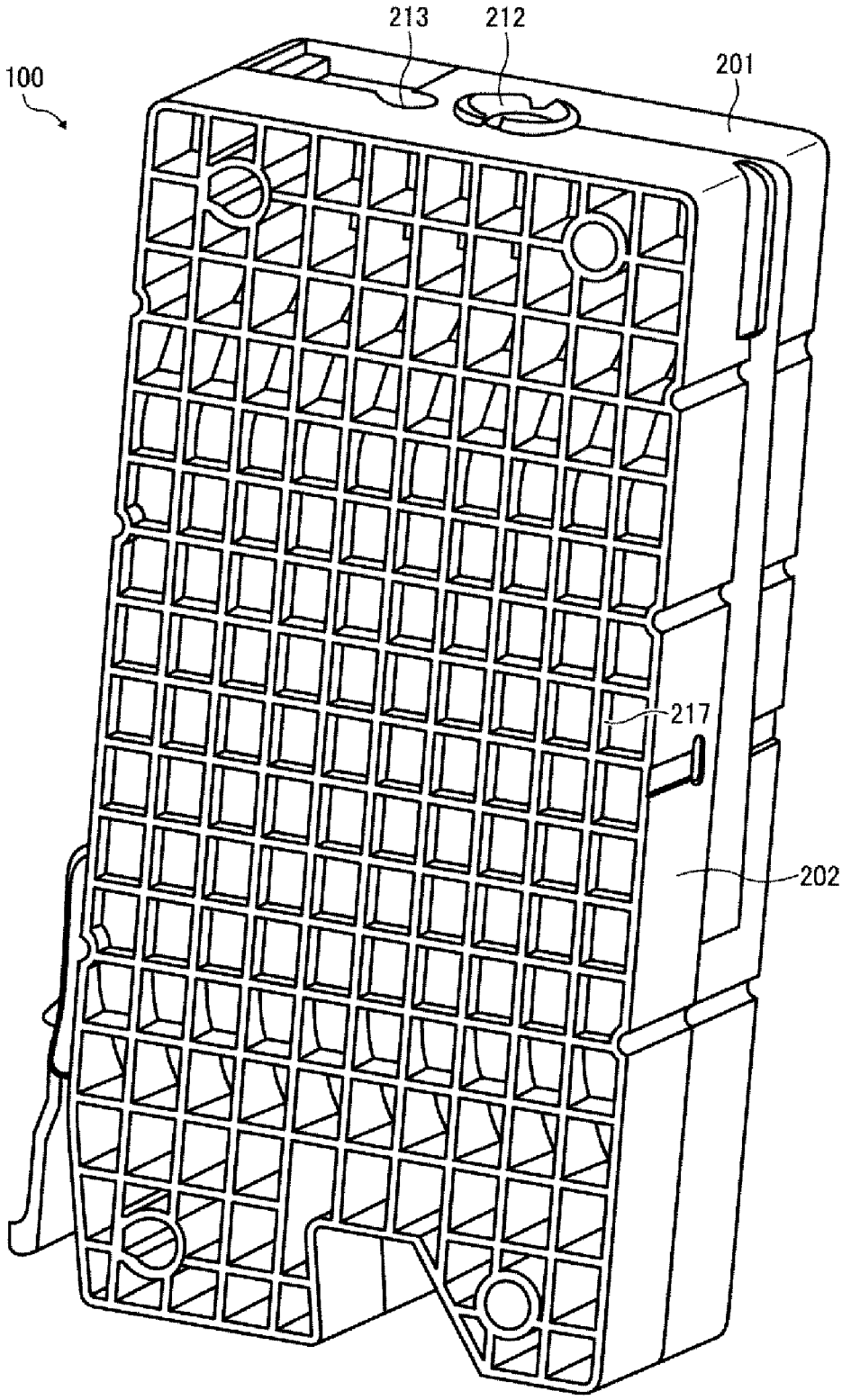
FIG. 5 is an external perspective view illustrating an example of an ink cartridge used in the inkjet recording apparatus.
Figure 6A:
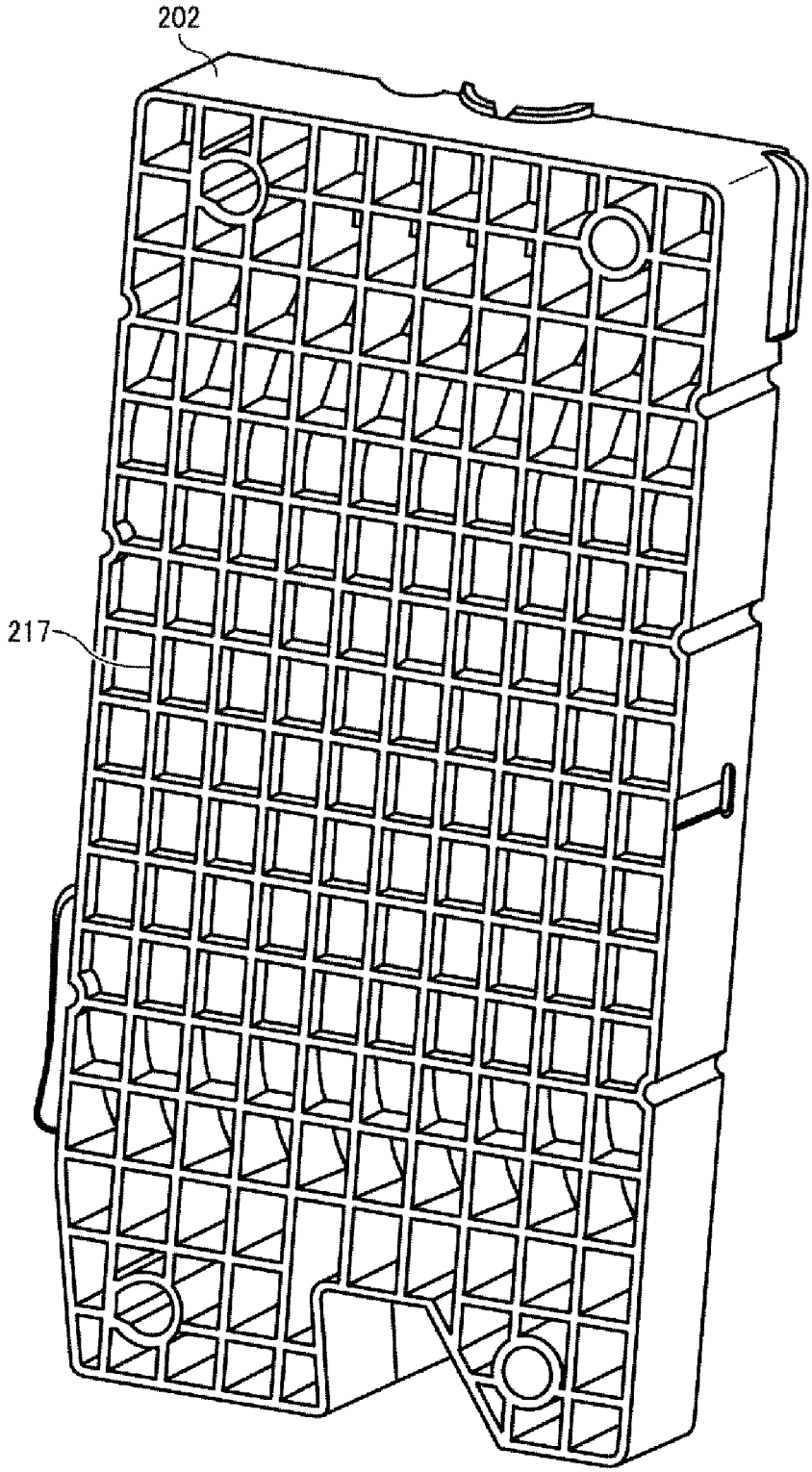
FIGS. 6A to 6C are exploded perspective views illustrating the ink cartridge illustrated in FIG. 5.
Figure 6B:
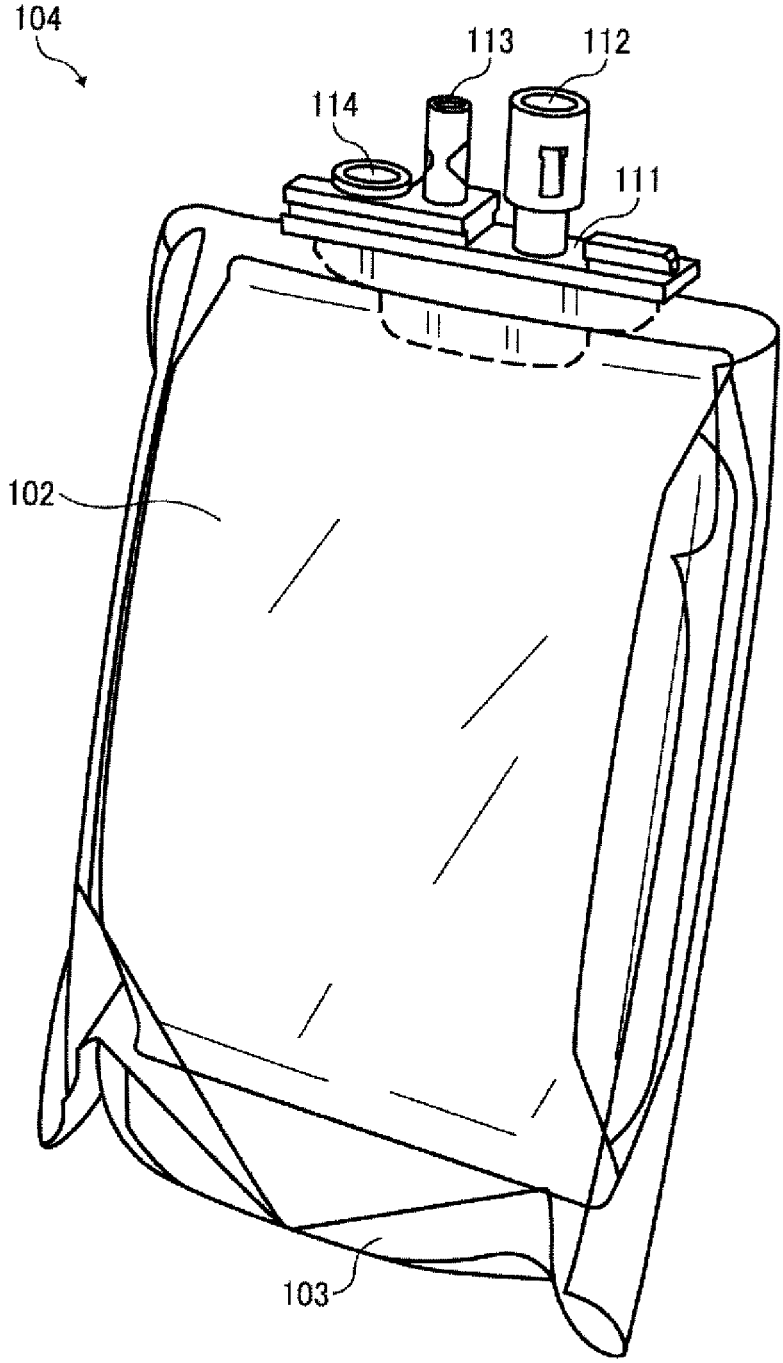
Figure 6C:
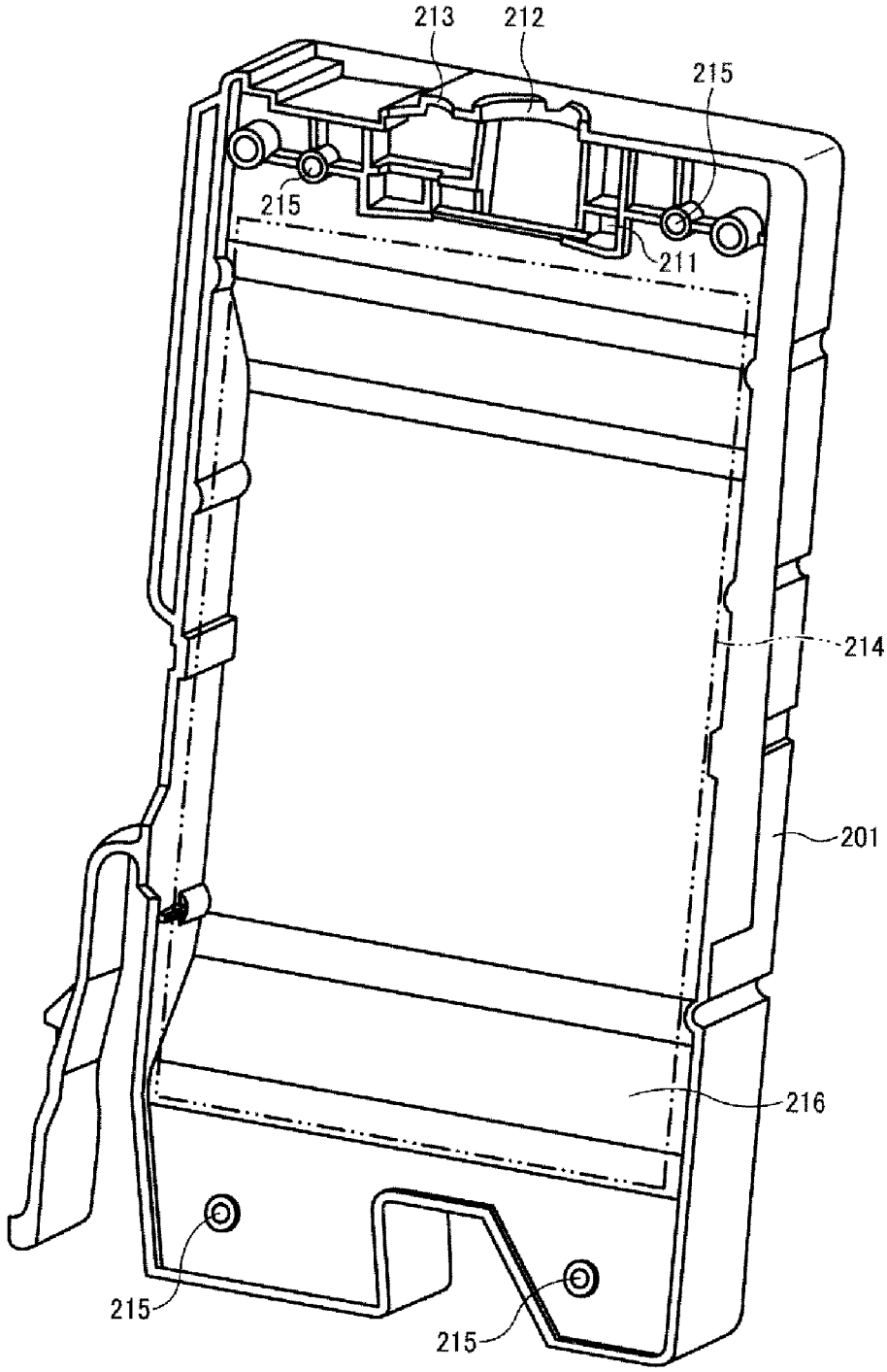
Figure 7:
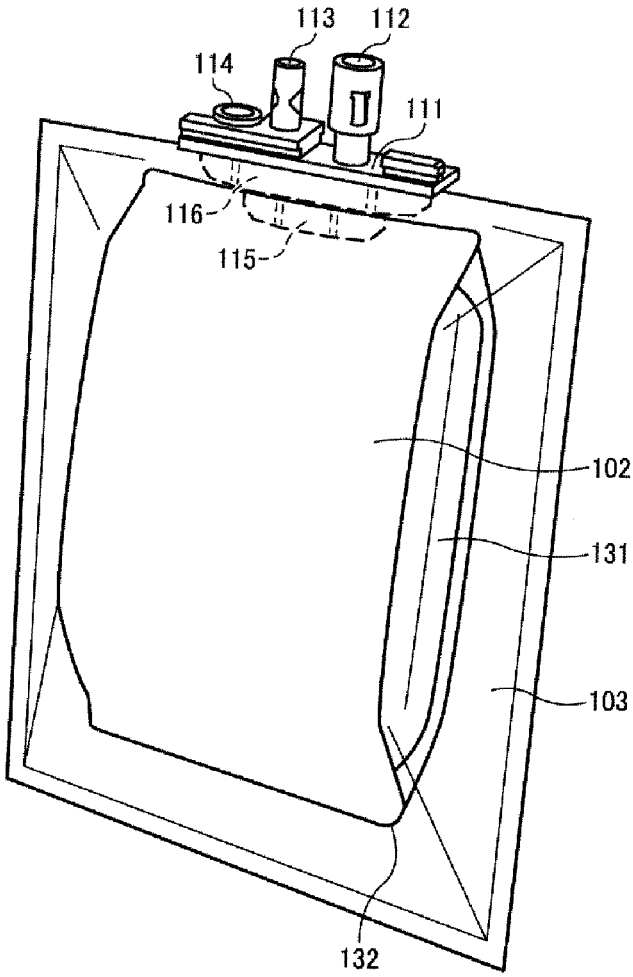
FIG. 7 is an external perspective view illustrating an ink pack and an air pack.
Figure 8:
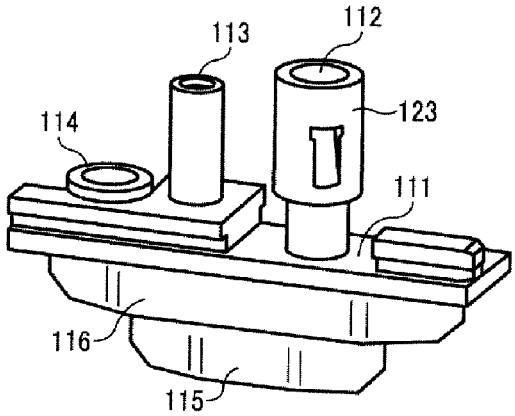
FIG. 8 is an enlarged perspective view illustrating a connection member.
Figure 9:
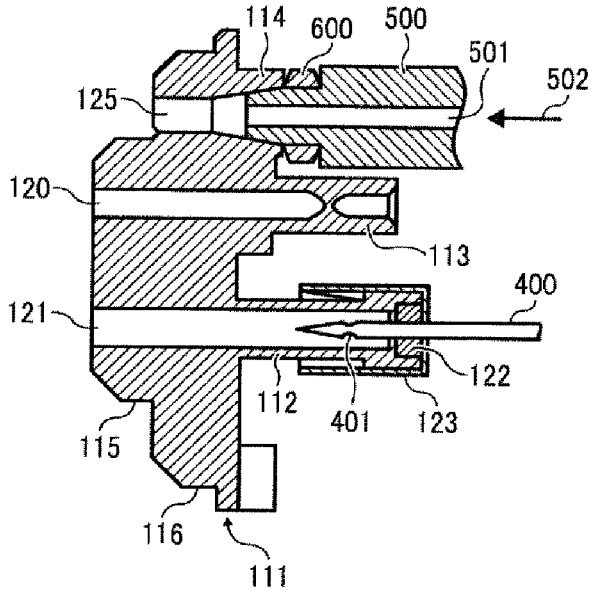
FIG. 9 is a cross-sectional view illustrating the connection member when the ink cartridge is mounted in the inkjet recording apparatus.
Figure 10:
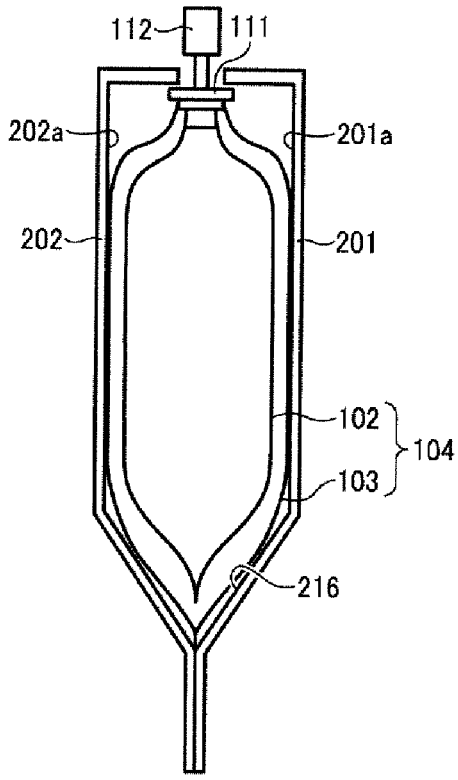
FIG. 10 is a schematic sectional view illustrating a double pack.

FIG. 5 is an external perspective view illustrating a configuration of the ink cartridge 100. FIGS. 6A to 6C are exploded perspective views illustrating the configuration of the ink cartridge 100. FIG. 7 is an external perspective view illustrating a configuration of the double pack 104 including the ink pack 102 and the air pack 103. FIG. 8 is an enlarged perspective view illustrating a connection member 111 illustrated in FIG. 7. FIG. 9 is a cross-sectional view illustrating the connection member 111 when the ink cartridge 100 is mounted in the inkjet recording apparatus 1. FIG. 10 is a schematic sectional view illustrating the double pack 104.

The double pack 104 of the ink cartridges 100 is fixed at the connection member 111 by welding so that the ink pack 102 is located inside the air pack 103. The connection member 111 is integrally molded from resin such as polyethylene and includes a supply port 112 through which ink of the ink pack 102 is supplied to the recording head 20, a filling port 113 from which ink is filled to the ink pack 102, an air inlet port 114 from which air is introduced into a space between the ink pack 102 and the air pack 103, a first welding portion 115 at which the ink pack 102 is welded, and a second welding portion 116 at which the air pack 103 is welded.

The filling port 113 has an internal channel 120. After ink is filled in the ink pack 102, the internal channel 120 is sealed with a sealing portion 113*a* by heat welding. The supply port 112 has an internal channel 121 and a rubber seal 122 at an end portion thereof. The rubber seal 122 is held with a cap member 123. By welding the ink pack 102 at the first welding portion 115, the internal channel 121 of the supply port 112 and the internal channel 120 of the filling port 113 are connected to the ink pack 102.

The air inlet port 114 has an internal channel 125. By welding the air pack 103 at the second welding 116, the internal channel 125 is connected to the space between the ink pack 102 and the air pack 103.

The ink pack 102 may be a flat-type pack in which circumferential edge portions of two rectangular pack pieces are welded. Alternatively, it may be preferable that a gadget 131 is formed on at least one edge of the ink pack 102 in a direction perpendicular to the edge of the ink pack 102 welded to the connection member 111. By forming the gadget 131, a pathway of ink is formed at a break of the gadget 131 even when the ink pack 102 is flattened after ink consumption. Such a configuration allows reducing the amount of unfinished ink in the ink pack 102, thus effectively using ink.

The ink pack 102 is made of, for example, a sheet material including an aluminum layer. Forming an R-shape portion 132 at corners of the ink pack 102 prevents the ink pack 102 from giving damage to the air pack 103 when the ink cartridges 100 is shaken or fallen.

In FIG. 7, the air pack 103 is a flat type in which circumferential edge portions of two rectangular pack pieces are welded. Alternatively, taking into account the welding performance of the air pack 103 against the cartridge case 101, the ink pack 103 may be a gadget-equipped pack as with the ink pack 102. Since the air pack 103 neither contacts nor stores ink, the air pack 103 may not include an aluminum layer.

The cartridge case 101 housing the double pack 104 is separatable into a base 201 and a cover 202. The connection member 111 of the double pack 104 is fittingly held with a first support-port engagement portion 211 of the base 201 and a second support-port double portion, not illustrated, of the cover 202. Each of the base 201 and the cover 202 has a first opening portion 212 corresponding to the supply port 112 of the connection member 111 of the double pack 104 and a second opening portion 213 corresponding to the filling port 113 and the air inlet port 119. In this example, the base 201 and the case 202 are screwed at four screwed portions 215. Alternatively, the base 201 and the case 202 may be fixed each other by snap fit or any other suitable manner.

The air pack 103 of the double pack 104 is formed so that, when the air pack 103 is inflated to the maximum at a natural condition before installed to the cartridge case 101, the air pack 103 has a capacity greater than the capacity of an air-pack housing portion 214 for enclosing the air pack 103 that is formed when the base 201 is fitted with the cover 202. That is, the air pack 103 is formed to have a capacity greater than the capacity of the air-pack housing portion 214 of the cartridge case 101.

Thus, as illustrated in FIG. 10, when the double pack 104 is housed in the cartridge case 101 and air is introduced into the space between the ink pack 102 and the air pack 103, the air pack 103 is inflated (expanded) by air pressure to be pressed against inner wall surfaces 201*a* and 202*a*. As a result, further inflation of the air pack 103 is prevented.

That is, the pressure acting in the direction to expand the air pack 103 is received by the inner wall faces 201*a* and 202*a*, obviating the necessity for receiving air pressure by the air pack 103 itself. Such a configuration prevents breakage of the welding portion of the air pack 103. As a result, ink supply stoppage due to damage of the air pack 103 is prevented, thus allowing stable ink supply to the recording heads 20.

In other words, when the speed of ink supply is increased to perform high-speed printing, air pressure supplied to the air pack 103 is increased. Further, when the ink capacity of the ink cartridge 100 is increased to reduce the replacement frequency of the ink cartridge 100 for enhancement of usability, the size of the air pack 103 is also increased. In such a case, if high pressure is received by such an increased size of the air pack 103, a great amount of weight might be applied to, in particular, the welding portion, causing breakage. Hence, in the present illustrative embodiment, expansion of the air pack 103 is received by the cartridge case 101 to prevent breakage of the air pack 103, thus allowing stable ink supply even when the capacity of the ink cartridge 100 is increased to enhance the printing speed.

Further, in the present illustrative embodiment, the cartridge case 101 has inclined faces 216 corresponding to an end portion of one edge of the ink pack 102 disposed in a direction perpendicular to the edge(s) of the ink pack 102 at which the gadget 131 is formed. The inclined faces 216 are inclined inward to form a taper portion. The air-pack housing portion 214 that encloses the air pack 103 formed by fitting the base 201 with the cover 202 has a capacity slightly greater than the size of the ink pack 102 at a state in which the ink pack 102 is full of ink. Such a configuration reduces the amount of air to be introduced into the air pack 103, thus shortening the time required for increasing the internal pressure of the air pack 103 to a target value.

Further, as described above, at or around the time of supplying ink, for example, a pressure of approximately 5 to 100 kPa is applied in the air pack 103 and received by the base 201 and the cover 202 of the cartridge case 101. Hence, a reinforcement rib 217 is formed on the outer side of each of the base 201 and the cover 202. In this regard, it is conceivable that such a reinforcement rib is provided at the inner side of each of the base 201 and the cover 202. In such a case, however, when the air pack 103 is pressurized or the ink cartridge 100 is shaken or fallen, the air pack 103 might be damaged by the edge of the reinforcement rib. Hence, as described above, the reinforcement rib 217 is provided at the outer side of each of the base 201 and the cover 202.

Next, a description is given of the state in which ink is supplied with reference to FIG. 9.

A compressed air 502 is supplied through a channel 501 of the air joint 500 connected to the pump 25 provided in the inkjet recording apparatus 1. The compressed air 502 is further supplied through the internal channel 125 to the space between the air pack 103 and the ink pack 102.

The air joint 500 is biased toward the connection member 111 of the double pack 104. As a result, an air sealing member 600 made of elastic material is bent to firmly attach the air joint 500 with the air inlet port 114. Such a configuration allows supplying highly pressurized air substantially without leakage.

Further, the hollow needle 400 provided in the inkjet recording apparatus 1 is inserted into the internal channel 121 through the rubber seal 122. A pressure generated by pressurizing the air pack 103 squeezes the ink pack 102 storing ink in a direction in which the ink pack 102 is flattened. Thus, ink in the ink pack 102 is supplied from an opening 401 of the hollow needle 400 through the hollow needle 400 and the supply tube 24 to the recording head 20.

As described above, according to the above-described illustrative embodiments of the present disclosure, the ink cartridge includes an inner pack that stores ink, an outer pack that packs the inner pack and into which air is introduced to squeeze the inner pack to supply the ink to an exterior of the ink cartridge, and a cartridge case that houses the outer pack. When air is introduced into the outer pack, the outer pack is inflated to be pressed against an inner wall face of the cartridge case. Such a configuration allows the cartridge case to receive the pressure generated when air is introduced into the outer pack. Accordingly, breakage of the outer pack is prevented, thus allowing stable ink supply with enhanced capacity, speed, and cost effectiveness.

The image forming apparatus according to the above-described illustrative embodiment includes the above-described ink cartridge, thus allowing stable ink supply and image formation.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the scope of the present invention, and all such modifications are intended to be included within the scope of the present invention.

For example, elements and/or features of different illustrative embodiments may be combined with each other and/or substituted for each other within the scope of this disclosure and appended claims.

The present patent application claims priority pursuant to 35 U.S.C. §119 from Japanese Patent Application No. 2009-000630, filed on Jan. 6, 2009 in the Japan Patent Office, which is incorporated herein by reference in its entirety.

What is claimed is:

1. An ink cartridge, comprising:

an inner pack that stores ink;

an outer pack that packs the inner pack and into which gas is introduced to squeeze the inner pack to supply the ink to an exterior of the ink cartridge; and a cartridge case having a housing portion to enclose the outer pack and an inner wall surface against which the outer pack is inflated to be pressed as gas is introduced into the outer pack, wherein the outer pack is configured to have a capacity that, when inflated to a maximum at atomospheric pressure, is greater than a capacity of the housing portion of the cartridge case.

2. The ink cartridge according to claim 1, wherein the outer pack is inflated to be pressed against a substantially whole area of the inner wall surface as gas is introduced into the outer pack.

3. The ink cartridge according to claim 1, wherein the cartridge case has a taper portion at a position corresponding to an end portion of the inner pack.

4. The ink cartridge according to claim 1, wherein the cartridge case is formed of two case members that sandwich an edge portion of the outer pack.

5. An image forming apparatus comprising an ink cartridge detachably mountable in the image forming apparatus, the ink cartridge comprising:

an inner pack that stores ink;

an outer pack that packs the inner pack and into which gas is introduced to squeeze the inner pack to supply the ink to an exterior of the ink cartridge; and a cartridge case having a housing portion to enclose the outer pack and an inner wall surface against which the outer pack is inflated to be pressed as gas is introduced into the outer pack, wherein the outer pack is configured to have a capacity that, when inflated to a maximum at atomospheric pressure, is greater than a capacity of the housing portion of the cartridge case.

6. The image forming apparatus according to claim 5, wherein the outer pack is inflated to be pressed against a substantially whole area of the inner wall surface as gas is introduced into the outer pack.

7. The image forming apparatus according to claim 5, wherein the cartridge case has a taper portion at a position corresponding to an end portion of the inner pack.

8. The image forming apparatus according to claim 5, wherein the cartridge case is formed of two case members that sandwich an edge portion of the outer pack.

* * * * *